United States Patent [19]

Hoexter

[11] 4,235,143

[45] Nov. 25, 1980

[54] SIMULATED VIOLONCELLO

[76] Inventor: Robert S. Hoexter, 2540 Craig Rd., Ann Arbor, Mich. 48103

[21] Appl. No.: 957,728

[22] Filed: Nov. 6, 1978

[51] Int. Cl.[3] ..... G10H 3/00

[52] U.S. Cl. ..... 84/1.16; 84/1.15; 84/280; 84/465; 84/470 R

[58] Field of Search ..... 84/1.14, 1.15, 1.16, 84/307, 275, 470, 470 R, 277, 280, 327, 173, 267, 270, 291, 294, 362, 410, 465; 248/166, 168, 188.6

[56] References Cited

U.S. PATENT DOCUMENTS

| | | | |
|---|---|---|---|
| 735,428 | 8/1903 | Unger | 84/277 |
| 1,861,717 | 6/1932 | Pfeil | 84/1.16 |
| 1,900,489 | 3/1933 | Eisenberg | 84/1.16 |
| 2,141,735 | 12/1938 | Borg | 84/277 |
| 2,155,741 | 4/1939 | Severy | 84/1.15 |
| 2,223,190 | 11/1940 | Smith | 84/307 |
| 2,974,556 | 3/1961 | Fawick | 84/327 |
| 3,049,958 | 8/1962 | Benloff | 84/1.16 |
| 3,811,357 | 5/1974 | Stewart | 84/327 |
| 3,813,473 | 5/1974 | Terymenko | 84/1.16 |
| 3,910,151 | 10/1975 | Copeland | 84/267 |
| 4,104,945 | 8/1978 | Bolin | 84/294 |

*Primary Examiner*—J. V. Truhe

*Assistant Examiner*—Forester W. Isen

*Attorney, Agent, or Firm*—Maurice L. Miller, Jr.

[57] ABSTRACT

A simulated violoncello having an elongated body shaped in conformity with the fingerboard of a violoncello and a pair of curved panels adapted for confinement between the knees of the user and attached to the body to simulate the knee-held side portions of the resonance box of a violoncello is disclosed. The panels may be attached to a block which slidably engages a rail of trapezoidal cross-section formed along the back of said body and extending along a lower portion of the length thereof, whereby the height of said panels can be adjusted. An elongated floor support arm is attached to a lower end of the block which is removable and reversably disposable upon the rail so as to place the floor support arm in a stored position behind and adjacent the body of the instrument. A magnetic pick-up is disclosed having a housing defining a chamber in which a hardwood block is disposed, to which is attached a softwood vibratile member containing a permanent magnet in the free end thereof aligned along the center line of a hollow electrical coil. The body of the instrument may be constructed of hardwood so as to resist warpage and transmit string vibrations with low attenuation to the softwood member.

9 Claims, 6 Drawing Figures

SIMULATED VIOLONCELLO

BACKGROUND OF THE INVENTION

This invention relates generally to simulated string musical instruments and magnetic pick-up means therefor and more specifically to a simulated violoncello.

Electrical and magnetic pick-up means for string instruments are generally well known in the prior art. See, for example, the electrical pick-up disclosed in U.S. Pat. No. 1,861,717 issued to V. A. Pfeil on June 7, 1932 wherein the transverse vibrations of the strings cause a proportionate vibration in an arc-shaped bridge mounted on resilient, deformable pads. The vibration of the bridge is directly imparted to an armature which is partially constrained by a pivot bearing so as to rock toward and away from the pole of a magnet, thus inducing an electrical current in a circuit corresponding to the string vibrations.

See also U.S. Pat. No. 2,223,190 issued to H. S. Smith on Nov. 26, 1940 which discloses a magnetic pick-up for use with a bass viol. In this patent, a bass viol having a solid body defining a cavity therein is disclosed. A fingerboard, along which strings are strung, is mounted on the body so as to vibrate relative to the body in sympathy with the string vibrations. An armature disposed in the cavity is directly connected to the fingerboard so as to vibrate with the latter and thereby transmit such vibrations to a magnet which, in turn, moves relative to an associated coil to induce and electrical potential in the coil corresponding to the vibration of the fingerboard.

One difficulty encountered with these prior art pick-up assemblies is their relative complexity and number of moving parts. For example, a vibrating bridge or fingerboard, an armature directly connected thereto which rocks or vibrates so as to vibrate a magnet relative to a coil is required. In each case, the quality of electrical signal generated in the coil is dependent upon the vibration characteristics of a metal bridge or wooden fingerboard mechanically linked to an armature element.

It has also been known to the prior art that various string instruments may be simulated by removal of the resonance box therefrom and using a pick-up to generate an electrical vibration corresponding to string vibration which may then be amplified electronically, also as disclosed in the previously cited reference patents. Elimination of the resonance box to provide a simulated instrument for practice purposes is desirable since beginning students can thereby be exposed to the feel of a fine concert instrument by use of a relatively inexpensive simulation in practice sessions. The patent to Pfeil discloses a simulated violin, while the patent to Smith discloses a simulated bass viol. By means of my invention, I provide a simulated violoncello which, in addition to its usefulness as a relatively inexpensive practice instrument is capable of generating a rich and mellow musical sound approximating that of a concert violoncello to a high degree of accuracy. The instrument of my invention generates a relatively attenuated sound because of the absence of the traditional resonance box so that it may be played without disturbing neighbors or others within the household or surrounding area.

SUMMARY OF THE INVENTION

It is one object of my invention to provide a simulated violoncello.

It is another object of my invention to provide a simulated violoncello having adjustable panels shaped in conformity with the knee-confined side portions of the resonance box of a traditional violoncello.

It is yet another object of my invention to provide a string instrument employing pick-up means for amplifying and enriching the sound generated by the strings in a manner usually obtained by use of a resonance box, without resorting to use of the latter.

It is still another object of my invention to provide a simplified tone enriching pick-up utilizing a softwood vibratile member securely fixed at one end thereof in a hardwood material capable of transmitting sound therethrough to the vibratile member with low attenuation.

Briefly, in accordance with my invention, I provide a simulated violoncello having an elongated body shaped in conformity with the fingerboard portion of a traditional violoncello. A series of strings is stretched along the body. A pair of panels adapted for confinement between the knees is attached to the body, the panels being shaped in conformity with the knee-confined side portions of the resonance box of a violoncello.

Additional objects, features and advantages of my invention will become apparent to those skilled in the art from the following detailed description and attached drawings upon which, by way of example, only a preferred embodiment of my invention is illustrated.

DESCRIPTION OF THE PREFERRED EMBODIMENT

Figure 1:
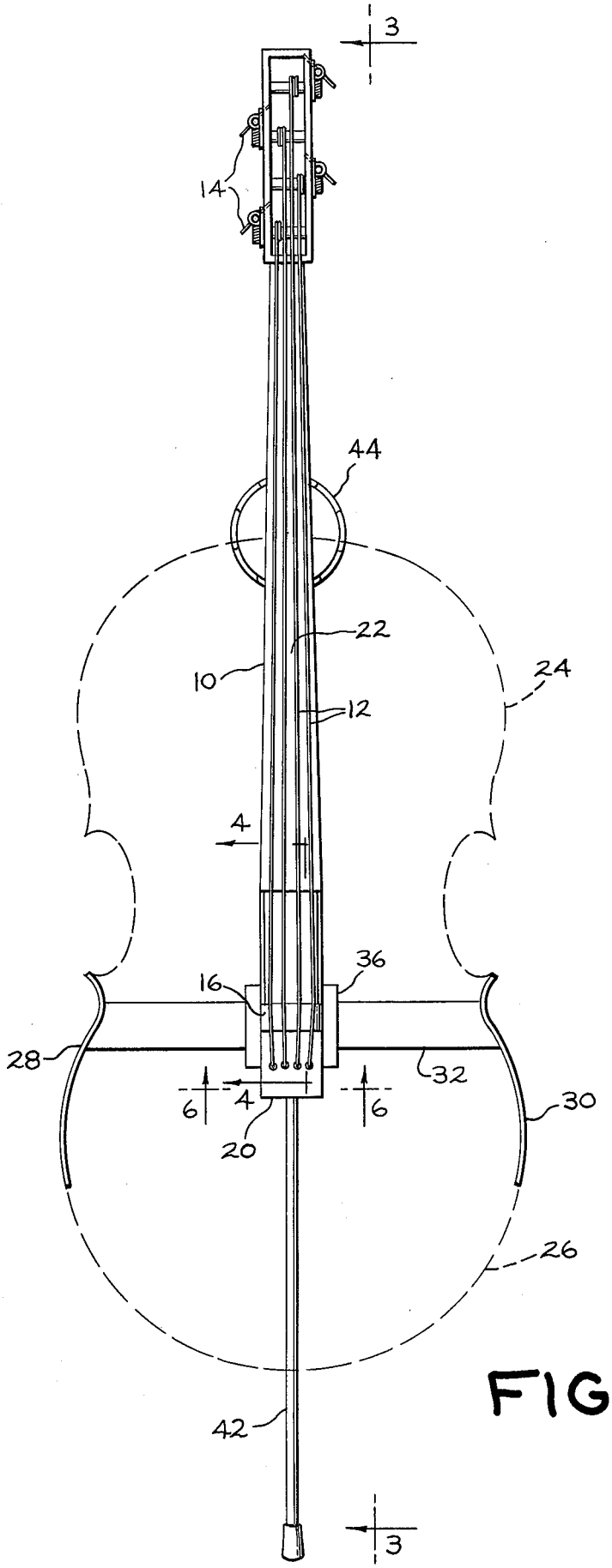
FIG. 1 shows a front elevation view of a simulated violoncello thus illustrating one preferred embodiment of my invention.

Referring now to the drawings, there is shown, in one preferred embodiment of my invention, a simulated 'cello having an elongated body 10 constructed preferably of a hardwood, although other suitable materials may be employed. A set of strings 12 is strung along the body 10 extending from a series of string tension adjusting screws 14 downwardly across a bridge 16 and through a set of hollow shafts 18 extending diagonally through a lower end portion of the body 10 to a lower end 20 thereof. It is preferable that all portions of the instrument which are to be touched or held when played be shaped or otherwise adapted to simulate the feel of a traditional cello. Such an adaptation renders the instrument of my invention particularly suitable for use as a practice instrument as well as for use in radio concerts, taping sessions, and the like. To this end, a playing surface portion 22 of the body 10, underlying the strings 12, may be rounded or beveled in the usual, well known manner to simulate both the appearance and feel of a concert 'cello. The resonance box of an actual 'cello is represented by dashed lines 24 in FIG. 1. A pair of curved panel 28, 30 simulating the curvature of the knee-confined side portions of the resonance box of a concert 'cello are attached by threaded fasteners or by other suitable means to the ends of a transversely extending support member 32. The distance of each of the panels 28, 30 from the longitudinal center line of the body 10 should be selected for the comfort of the particular musician using the instrument.

Figure 2:
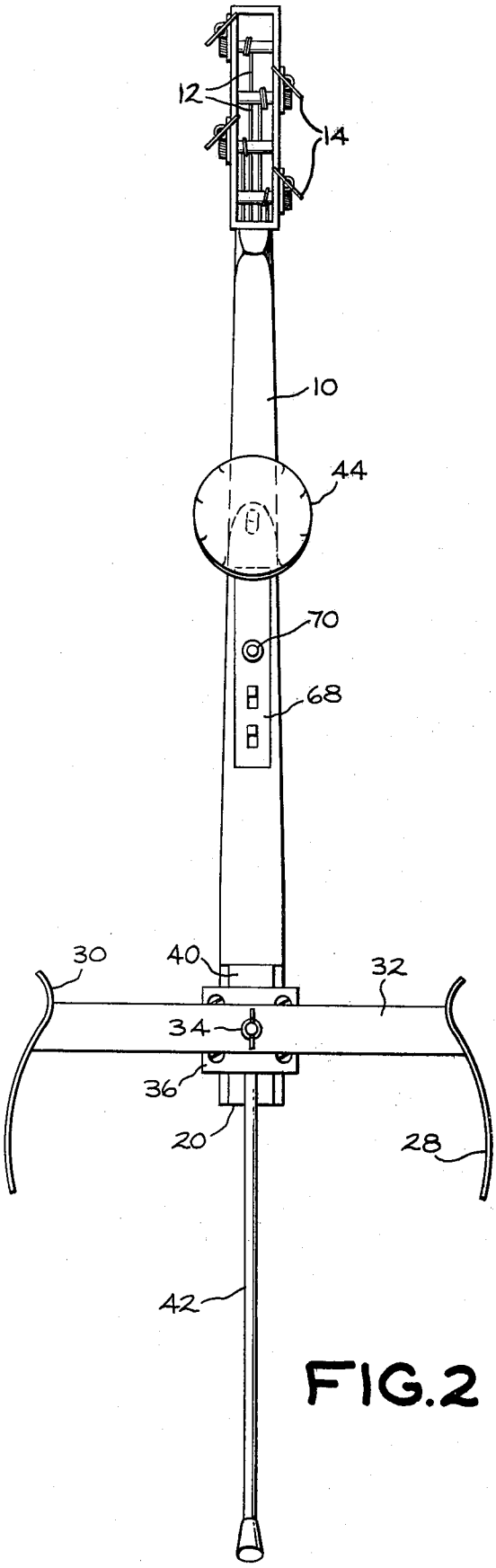
FIGS. 2–3 show rear and side elevation views, respectively, of the simulated violoncello of FIG. 1, FIG. 3 being a fragmented portion of the violoncello of FIG. 1 as viewed along lines 3—3 of the latter figure.
Figure 3:
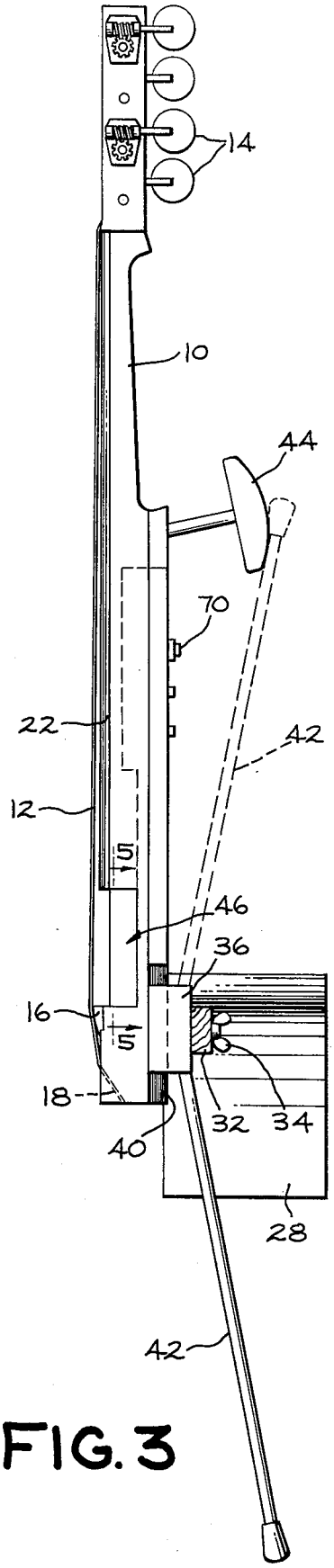
Figure 4:
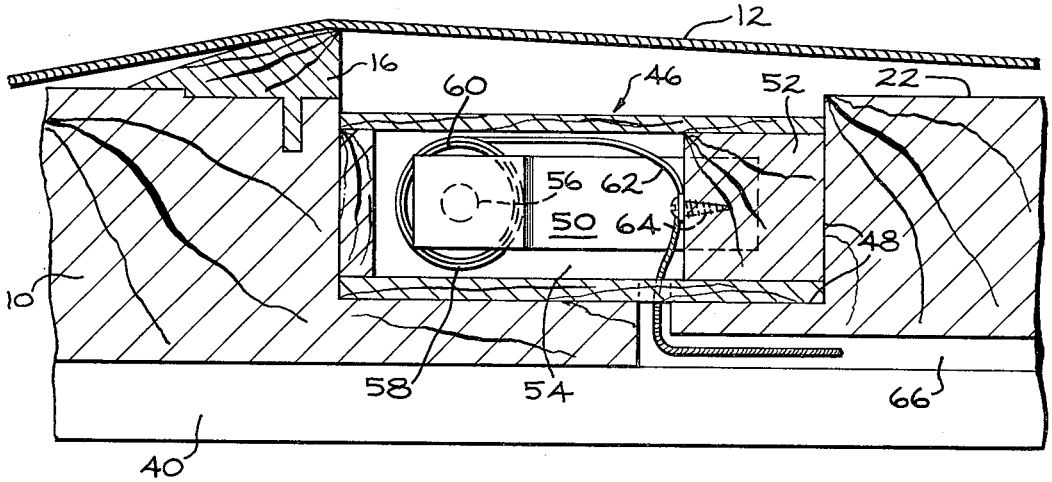
FIG. 4 shows a cross-sectional view of a portion of the violoncello of FIGS. 1–3 as viewed along lines 4—4 of FIG. 1.
Figure 5:
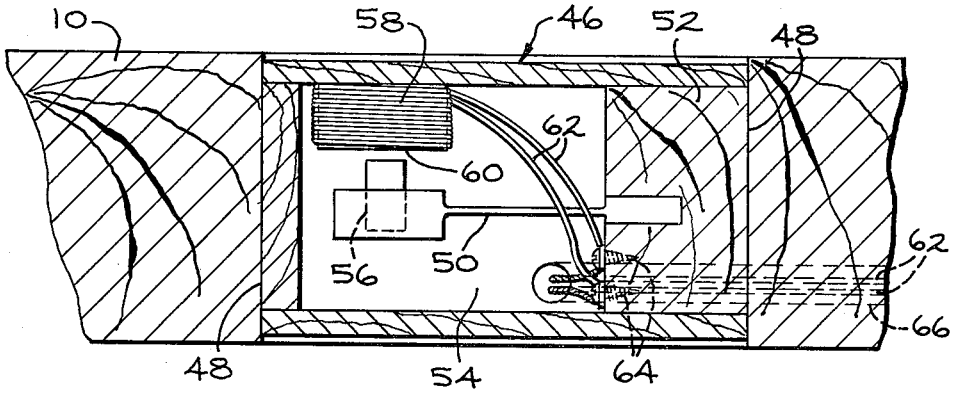
FIG. 5 shows a cross-sectional view of a portion of the violoncello of FIGS. 1–3 as viewed along lines 5—5 of FIG. 3.
Figure 6:
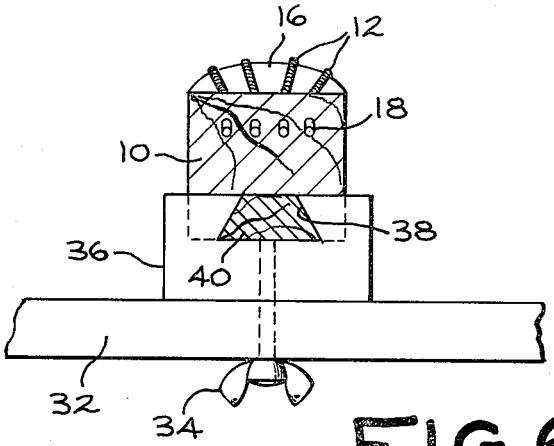
FIG. 6 shows a cross-sectional view of a portion of the violoncello of FIG. 1 as viewed along lines 6—6 thereof.

The member 32 is secured by a threaded fastener 34 at the mid-point of its longitudinal dimension to a slidable block 36 removably mounted on the back of the body 10. The block 36 defines a tapered channel 38 which conforms to and slidably engages a tapered rail 40 of trapezoidal cross-section (see FIG. 6) formed in the back of the body 10 and opening onto the lower end 20. The fastener 34 also secures the block 36 to the desired position on the rail 40 as most clearly shown in FIG. 6. A support arm 42 extends from a hollow shaft formed in a lower portion of the block 36. By loosening the fastener 34, the block 36 may be moved along the rail 40 to adjust the panels 28, 30 and the lower end 20 to a convenient height above the floor to suit the individual musician. The removable block 36 allows the instrument to be partially disassembled for ease of transportation and storage. By removing the block 36 from the lower end of the rail 40, the block 36 may be turned around 180 degrees from its position as shown in FIGS. 1-3 and reinstalled upon the rail 40 so that the arm 42 extends diagonally upward along the back of the body 10 in a stored position as indicated by dashed lines 42' in FIG. 3. To further simulate the feel of a concert 'cello, a suitable chest pad 44 is attached to the back of the body 10 so as to extend outwardly to engage the chest of the user at approximately the same position as would the upper end portion of the resonance box of a traditional 'cello as best indicated by FIG. 1. The pad 44 may also serve as a support for the free end of the support arm 42 when the latter is disposed in its stored position 42' (FIG. 3).

An additional feature of my invention is a pick-up transducer assembly 46 slidably disposed in tight fitting relation in a rectangular slot 48 formed in a front portion of the body 10 just above the bridge 16. The assembly 46 includes a softwood reed or vibratile member 50 cantilevered from a slot formed in a hardwood block 52 into an enclosed chamber 54. The member 50 is trimmed to form a relatively broad, flat rectangular strip whose natural frequency of resonance is below the lowest fundamental musical note generated by the strings 12. In this manner, I have found that the sonic response of the softwood member 50 will be relatively even throughout the traditional musical range of a 'cello. The free end of the member 50 contains a cylindrically shaped permanent magnet 56 projecting outwardly toward the center of an electrical coil 58 wound about a suitable dielectric form 60 attached to a side wall of the assembly 46. Vibration of the member 50 in sympathy with the vibration of the strings 12 forces the magnet 56 to move toward and away from the interior of the coil 58 to generate a corresponding electrical signal in a pair of lead wires 62. The broad surface of the member 50 is aligned so that the member 50 will be substantially responsive only to the lateral vibrations of the strings 12 which are approximately parallel to the fingerboard 22. In this manner, the undesirable transverse vibrations of the strings 12 which are approximately perpendicular to the finger board 22 such as those that frequently occur due to the action of a musician's fingers upon the strings 12 are highly attenuated by the member 50. The wires 62 are secured to a pair of wood screws 64 inserted into the block 52. The screws 64 also serve as terminals from which the wires 64 extend downwardly through the chamber 54 and into a hollow shaft 66 which leads up the back of the body 10 to a chamber containing a conventional detector and audio amplifier 68 of any suitable and well known type. The amplifier 68 has an output jack 70 which can be connected to a set of earphones, a linear amplifier, or a speaker as desired. Note that the member 50 is disposed in the chamber 54 so as to vibrate in the same direction as the strings 12 when set into vibration with a bow.

I have found that the hardwood body 10 acts as an excellent transmitter of the vibrations of the strings 12 to the softwood vibratile member 50. It is desirable that the material of the body 10 be such as to produce the least possible attenuation of the string vibrations therethrough. Hardwoods which I have found desirable for use in the body 10 include birch and rock maple not only because of their excellent quality of sonic transmission but also because of their resistance to warpage. Also, I have found that a softwood member 50 rigidly attached to one end to a hardwood buffer material so as to provide a node at the fixed end, produces a mellow and rich vibration which, when converted by an electronic amplifier to sound, reproduces the mellowness and richness characteristic of the traditional 'cello to a high degree of accuracy. Thus, the rich musical quality of a traditional 'cello resulting from the use of a conventional resonance box can be approximated by my instrument to a high degree of accuracy without employing such a highly expensive component. Moreover, the structural simulation of a traditional 'cello provided by my instrument provides a student with the feel of the traditional instrument at a much reduced cost. Elimination of the traditional resonance box by means of my invention also eliminates the great care typically required in handling, storing and transporting of a traditional 'cello so as to avoid damage to this highly expensive component. Because a resonance box is not present in my instrument, students or musicians can practice without distribing others since the audible sounds generated by the strings alone are greatly attenuated as compared with the sounds emitted by a traditional 'cello. Yet by using earphones, the instrumentalist can enjoy the full richness of quality so typical of a fine concert instrument.

While varying dimensions of the member 50 are permissible within the scope of my invention, I have found that a softwood vibratile member suitable for use as the member 50 of the present example is obtained having a length of $2\frac{3}{4}$ inches, a width of its broad surface of $\frac{5}{8}$ inch and a depth of the vibrating portion of 3/32 inch. Softwoods, which I prefer to use in constructing the member 50 are fir and pine. Other coniferous woods should be suitable as well as any wood which exhibits a suitable flexibility and springiness when shaped as previously described and shown. Lastly, those skilled in the art will appreciate from the foregoing disclosure that the magnet coil 58 and magnet 56 is stationarily mounted against a wall of the enclosure 46 while the coil 58 is mounted on the free end of the member 50 so as to vibrate toward and away from the magnet 56. Such an interchange of the components 56 and 58 would not be a departure from the scope of my invention.

Although the present invention has been described with respect to specific details of a certain preferred embodiment thereof, it is not intended that such details limit the scope and coverage hereof other than as set forth in the following claims.

I claim:

1. A simulated violoncello comprising
an elongated body shaped in conformity with the fingerboard of a violoncello,
a series of strings stretched along said body,
a pair of panels adapted for confinement between the knees and adjustably attached to said body for movement to a desired position along a lower portion of the length of said body, said panels being shaped in conformity with the knee-confined side portions of the resonance box of a violoncello,
an elongated support member, said panels being connected to the ends of said member,
a rail having trapezoidal cross-section formed along the back of said body and extending along a lower end portion of the length thereof,
a block defining a channel opening along a surface thereof and conforming to said rail for slidable engagement therewith, and
fastening means projecting through said member and block for securing the same to said rail.

2. The violoncello of claim 1 further comprising magnetic pick-up means mounted on said body under said strings.

3. The violoncello of claim 2 wherein said pick-up means comprises
a housing defining an enclosed chamber,
a block of hardwood disposed in one end of said housing,
a softwood vibratile member having a natural frequency of resonance below the lowest fundamental frequency of vibration of said strings secured at one end to said hardwood block and cantilevered into said chamber,
a permanent magnet mounted on a free end portion of said vibratile member, and
a hollow electrical coil disposed in said chamber and attached to a sidewall of said housing, said magnet being aligned along the center line of said coil for vibratory movement relative to said coil to induce an electrical potential therein in accordance with the vibrations of said vibratile member.

4. The violoncello of claim 1 further comprising an elongated support arm attached to a lower surface of said block for supporting said body on a floor, said block being removable from a lower end of said rail, whereby said block may be reversibly mounted on said rail to place said support arm in a stored position adjacent the underside of said body.

5. The violoncello of claim 1 further comprising a chest pad mounted on an underside of said body for engaging the chest of the user at approximately the same position as an upper end portion of the resonance box.

6. The violoncello of claim 1 wherein said body is constructed of hardwood.

7. A magnetic pick-up of a string instrument comprising
a housing defining an enclosed chamber,
a mass of hardwood disposed in one end of said housing,
a vibratile member constructed of a relatively board, flat rectangular strip of a softwood secured at one end thereof to said mass and cantilevered into said chamber, and
electromagnetic circuit means disposed in said chamber and attached to said housing an vibratile member for generating an electric signal in response to vibrations of said vibratile member.

8. The pick-up of claim 7 wherein said circuit means comprises
a magnet, and
a hollow electrical coil, said magnet being aligned with the center line of said coil for vibratory movement of said magnet and coil relative to one another to induce an electrical potential in said coil.

9. A simulated violoncello comprising
an elongated body shaped in conformity with the fingerboard of a violoncello, a lower end portion of the underside of said body containing a tapered rail of trapezoidal cross-section opening onto the lower end of said body,
a series of strings stretched along said body,
a pair of curved panels adapted for confinement between the knees and shaped in conformity with the knee-confined side portions of a resonance box of a conventional violoncello,
an elongated supporting member having said curved panels attached to opposite ends thereof, said member being secured at the mid-point of its length to a lower end portion of said body on an underside of said body opposite the side containing said strings,
a block defining a channel therein which conforms to a slidably engages said rail, said member being attached at its mid-point to said block for relative adjustment of said block and supporting member to a desired position along said rail to adjust the level of said panels, and
fastening means projecting through said member and block for securing said member and block to said rail.

* * * * *